US006635004B2

(12) United States Patent
Conger

(10) Patent No.: US 6,635,004 B2
(45) Date of Patent: Oct. 21, 2003

(54) APPARATUS AND METHOD FOR REMOVING MATERIAL FROM A FABRIC WEB

(75) Inventor: Gary Lee Conger, Macon, GA (US)

(73) Assignee: Paragon Trade Brands, Inc., Norcross, GA (US)

( * ) Notice: Subject to any disclaimer, the term of this patent is extended or adjusted under 35 U.S.C. 154(b) by 0 days.

(21) Appl. No.: 09/951,743

(22) Filed: Sep. 14, 2001

(65) Prior Publication Data

US 2003/0054930 A1 Mar. 20, 2003

(51) Int. Cl.[7] ..... B31B 49/00

(52) U.S. Cl. ..... 493/373; 493/82; 493/83; 225/93

(58) Field of Search ..... 493/373, 82, 83, 493/85; 144/252.2; 83/24, 100, 177; 225/98, 99, 93

(56) References Cited

U.S. PATENT DOCUMENTS 3,435,737 A * 4/1969 Sarka ..... 493/373
4,217,164 A * 8/1980 La Mers ..... 156/541
4,295,842 A * 10/1981 Bell ..... 493/342
4,300,421 A * 11/1981 Yano et al. ..... 83/99
4,303,461 A 12/1981 La Mers
4,454,180 A 6/1984 La Mers
4,549,452 A * 10/1985 Jobst ..... 83/100
4,561,334 A * 12/1985 Sarka ..... 83/27
4,985,012 A * 1/1991 Marschke ..... 493/373
5,049,122 A 9/1991 Marschke
5,158,001 A * 10/1992 Udelhofen et al. ..... 83/100
5,193,471 A * 3/1993 Badillo et al. ..... 112/68
5,219,108 A 6/1993 Mineki
5,365,815 A * 11/1994 Pfaff, Jr. ..... 83/154
5,414,931 A * 5/1995 Wollermann ..... 30/90.1
5,788,284 A 8/1998 Hirst
5,826,475 A 10/1998 Mysliwiec
6,094,821 A * 8/2000 College et al. ..... 30/90.1
6,250,189 B1 * 6/2001 Mysliwiec ..... 83/37

* cited by examiner

*Primary Examiner*—Rinaldi I. Rada
*Assistant Examiner*—Louis Tran
(74) *Attorney, Agent, or Firm*—Hunton & Williams

(57) ABSTRACT

An apparatus and method for removing cutout material that is at least partially severed from a web has a vacuum passage for drawing a vacuum, and a vacuum inlet plate connected to the vacuum passage. The vacuum inlet plate has an inlet edge defining at least part of an opening into the vacuum passage. The inlet edge has first and second angled edge portions that converge at first and second angles relative to the machine direction, respectively, to meet at a vertex portion. The vertex portion constitutes the rearmost portion of the inlet edge relative to the machine direction.

31 Claims, 4 Drawing Sheets

APPARATUS AND METHOD FOR REMOVING MATERIAL FROM A FABRIC WEB

FIELD OF THE INVENTION

The present invention generally relates to absorbent garment and textile manufacturing. In particular, it relates to an apparatus and method for using a vacuum source combined with a vacuum inlet to remove die cutout waste material from a continuously moving web.

BACKGROUND OF THE INVENTION

Fabrics, such as textiles, woven materials and nonwoven materials constructed from natural or synthetic fibers, may be processed into garments or other assemblies by feeding them through processing lines. These processing lines may operate non-stop or with few interruptions. In many instances when a product being made in the processing line includes fabric or other sheet-like material, these materials are stored in roll form and fed into the line as a continuously moving web of material. When the roll runs out of fabric, a substitute roll may be inserted into the line with or without interrupting the activity of the line. The web may be processed in any number of ways, such as by folding, pinching, bonding, gluing, compressing, sewing, cutting, and the like. In many cases it is preferred that these operations be performed in the machine direction, that is, done in the direction that the material is moving without interrupting the constant flow of fabric along the line.

In many cases, fabric web may be cut to remove excess material. For example, holes may be cut in the web, or the sides of the web may be trimmed. In continuously moving manufacturing processes, cutting is often performed by running the web through a cutting assembly having a cutting die and a cutting anvil. The cutting die is typically a rotating drum that has raised ridges having sharp edges that sever the fabric of the web in a predetermined pattern and at predetermined intervals. The cutting anvil is typically a relatively smooth rotating drum that is located so that the fabric passes between the cutting die and the cutting anvil. The cutting anvil may also be a belt or other surface that moves in unison with the cutting die. When the web passes between the die and the cutting anvil, the fabric is pinched between the raised ridges of the die and the cutting anvil and severed by the sharp edges. Other cutting assemblies are also widely used in the various industries that employ processing lines, such as laser cutters, hydraulic jet cutters, ultrasonic cutters, fixed blade cutters, cutting stamps, and so on.

One problem that may be encountered when cutting material from a web is that the cutouts (i.e., the material removed from the fabric by the cutting device) may become entangled in, or otherwise foul, the machinery of the line. Consequently, a great degree of care is often taken to ensure that the cutouts are completely removed from the proximity of the line. The problems associated with cutout removal may be exacerbated when the line operates at relatively high speeds, in which case the unremoved cutouts must be removed very quickly, and may progress some distance along the line if not removed, causing problems in various other parts of the line.

If the cutouts are not fully removed, they may clog the line, become entangled in the product being assembled by the line, or cause other problems. In addition, if the cutting die fails to completely sever the cutout from the web, the cutout may remain connected to the web by strands of uncut fabric, causing clogging and other problems. It is also likely that a partially severed cutout will pull away from the fabric in such a manner that the remaining fabric of the web is torn or otherwise damaged. In any case, the productivity of the line may be reduced when it must be stopped for servicing, and the cost to the manufacturer may increase. In some applications, the down-time caused by partially severed or otherwise improperly removed cutouts may be one of the greatest inefficiencies of a processing line.

One conventional device that has been employed to remove cutouts is a vacuum. The vacuum pulls the cutouts away from the line before they become entangled or clogged. Conventional cutout vacuums have a roughly rectangular or slot-like opening located near the web to remove the cutouts. Such vacuums are typically unable to remove poorly severed cutouts. One attempted solution has been to increase the amount of vacuum, however, when the vacuum level is increased, the web tends to be pulled into the vacuum opening, causing damage to the web. In addition, when a cutout is incompletely severed from the web, higher vacuum levels may tear or otherwise damage the web as the cutout is pulled away from the web. High-pressure air jets have been used in conjunction with conventional vacuums to propel the cutouts into the vacuum inlet, however such devices are typically ineffective or unreliable. In response to the inability of low vacuum systems to remove partially-severed cutouts, and the damage caused to the web when it is pulled in to the vacuum inlet by high vacuum systems, efforts have focused on improving the quality of the cuts made by the cutting devices in order to minimize the number of partially-severed cutouts, rather than improving the manner in which the cutouts are removed.

Conventionally, in order to reduce the likelihood that cutouts are not fully severed from the web, manufacturers have employed cutting dies having relatively sharp edges to help ensure that the cutouts are fully severed. Such cutting dies may also be pressed against the cutting anvil with a greater amount of force. These solutions, however, may reduce the longevity of the cutting dies, as the sharper edges may tend to become dull at a relatively high rate to the point where they no longer provide optimal operation. In addition, such cutting dies may be relatively expensive to build, refinish, and service. Again, this problem is exacerbated in relatively high-speed lines, in which case the cutting dies may experience a relatively high frequency of use cycles.

These and other devices have been used in the particular context of the absorbent garment manufacturing industry. Absorbent garments, such as diapers, adult incontinence products, feminine care products, and the like, are often manufactured from continuous webs of nonwoven and film material. It is often desirable to produce these garments at as great a rate as possible, and as with other industries, when a processing line has to be stopped to deal with improperly cut or removed cutouts, the absorbent garment manufacturer often suffers a financial loss.

It would be desirable to provide an improved method and system for cutting and removing cutouts. It would be desirable for such a method and system to remove relatively poorly severed cutouts without damaging the web. It would also be desirable to increase the service life of the cutting device, and to increase the speed at which the processing line can operate. It would also be desirable to provide such a method and system at minimal cost. The present invention may be employed to provide these and other benefits.

SUMMARY OF THE INVENTION

The features of the invention generally may be achieved by an apparatus and method for removing cutout material from a web moving in a machine direction. The apparatus has a vacuum passage for conveying a vacuum to which is attached a vacuum inlet plate, which may be a substantially flat plate. The vacuum inlet plate has an inlet edge that forms at least part of an opening into the vacuum passage. The inlet edge has first and second angled edge portions that converge at first and second angles relative to the machine direction, respectively, to meet at a vertex portion. The vertex portion forms the rearmost portion of the inlet edge relative to the machine direction.

In one embodiment, the cutout material has a surface area of between about 100 square centimeters and about 1000 square centimeters. In another embodiment, the web and cutout are made of a fabric web of nonwoven materials. In another embodiment, the web may be moving in the machine direction at a speed of between about 50 meters per minute and about 500 meters per minute.

In another embodiment, the vacuum is between about 0.496 to about 3.74 kPa with intermittent vacuum levels between about 3.74 to about 7.47 kPa. In yet another embodiment, the vacuum increases in inverse proportion with the degree to which the cutout material has been severed from the web.

In still another embodiment the vacuum inlet plate is separated from the web by a static offset distance, as measured when the web is stationary and the vacuum is zero, which may be between about 0.635 and 15.25 centimeters (0.25 to 6 inches). In one embodiment, the static offset distance may be chosen to be lower when the web has a relatively high resistance to deflection and higher when the web has a relatively low resistance to deflection.

In another embodiment, the vacuum inlet plate is tilted along the machine direction to be oriented relative to the fabric web at a static angle of attack, as measured when the fabric web is stationary and the vacuum source is zero. The static angle of attack may be less when the web has a relatively high resistance to deflection and greater when the web has a relatively low resistance to deflection. In one embodiment, the static angle of attack is between about −5 degrees and about 15 degrees. In another embodiment, the static angle of attack is about zero degrees.

In still other embodiments, the widest portion of the opening into the vacuum passage is between about 90% to about 120% of the width of the cutout material, and may be between about 100% to about 110% of the width of the cutout material. In other embodiments, the widest portion of the opening into the vacuum passage is between about 21.59 centimeters and about 29.21 centimeters (about 8.50 to 11.5 inches), and may be about 25.4 centimeters (10 inches).

In one embodiment, the vacuum inlet plate has an inner face facing the vacuum passage and an outer face opposite the inner face. In one such embodiment, the outer face is chamfered along at least part of the inlet edge.

In one embodiment, the first and second angles are approximately equal in magnitude to one another. In another embodiment, the first and second angles are between about 20 degrees and about 80 degrees. In yet another embodiment, the first and second angles are between about 35 degrees and about 65 degrees. In still another embodiment, the first and second angles are between about 50 degrees and about 55 degrees. In yet another embodiment, the first and second angles are about 52 degrees. The first and second angles may be relatively great when the web has a high resistance to deflection and relatively less when the web has a low resistance to deflection.

The vertex portion has a radius of between about 0.635 centimeters and about 3.81 centimeters (0.25 to 1.5 inches) in one embodiment. In other embodiments, the vertex portion may have a radius of between about 1.27 centimeters and about 2.54 centimeters (0.50 to 1.0 inch), and may be about 1.91 centimeters (0.75 inches).

In another embodiment of the invention, the inlet edge also has first and second straight edge portions extending forward and substantially parallel with the machine direction from respective ends of the first and second angled edge portions opposite the vertex portion.

These and other advantages of the invention will become readily apparent when the detailed description is read in conjunction with the drawing figures.

DETAILED DESCRIPTION OF THE PREFERRED EMBODIMENTS

Figure 1:
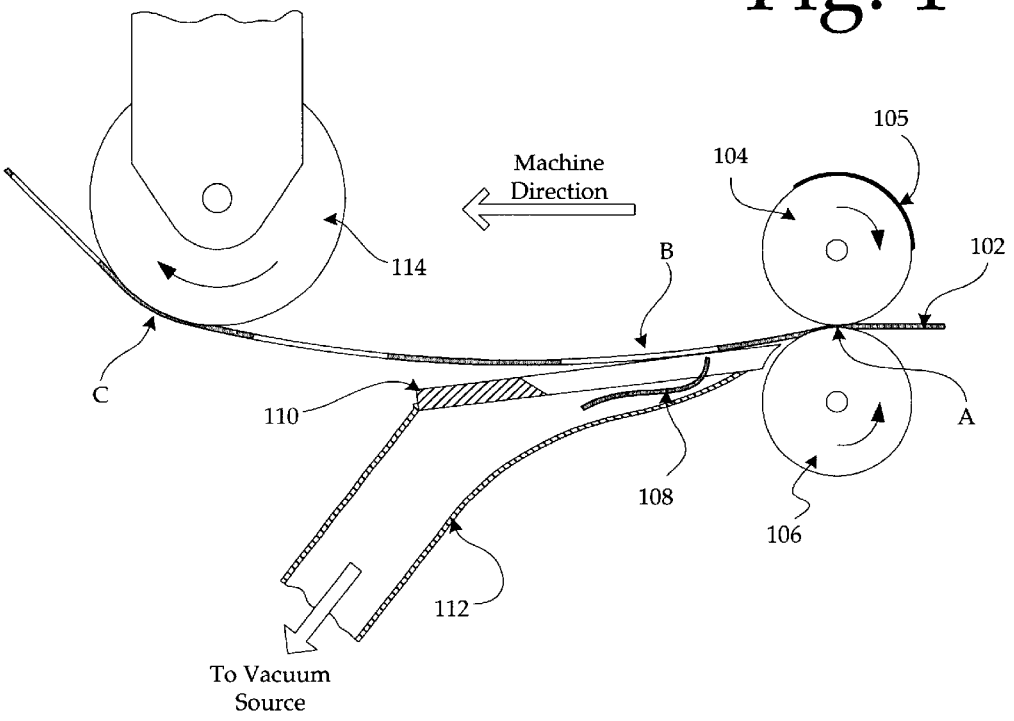
FIG. 1 is a partially cut away schematic side view of one preferred embodiment of the present invention.

As understood herein, "processing line" or "line" refers to any manufacturing or assembly line. Such processing lines may operate substantially non-stop, and may move in substantially one direction, or may operate in several directions. Supplies of material may be fed into the line, from any direction, as a continuous supply, or as an intermittent supply. The material fed into the line is generally processed, such as by cutting, joining, folding or stacking the material at various processing stations. Each processing station may process the material in one or more ways. Waste material, such as fabric cutouts, may exit the line at any point. The present invention may be used with any processing line, and the following description is not intended to limit the scope of the application of the invention.

The "machine direction," as used herein, is the primary direction in which material is traveling through the processing line at any given point. The material moving through the processing line generally originates from the "upstream" direction and moves in the "downstream" direction as it is processed. A "forward" or "foremost" portion of a part of the invention is located in the upstream direction, and a "rearward" or "rearmost" portion of a part is in the downstream direction (i.e., an imaginary point on the material moving through the processing line passes the forward and foremost portions of a part prior to passing the rearward and rearmost portions of that part).

As used herein, "fabric" refers to any woven cloth, nonwoven material, foam, mesh, film, paper, thin plastics and elastics, and the like. In addition, "fabric" may also refer to any substantially flat material (i.e., having a compressed thickness of less than about one quarter of the overall width or length of the finished product). A "fabric" may also be an aggregation or laminate of the above materials. A "fabric web" or "web" is a substantially continuous supply of fabric that may be fed into a processing line. The fabric web may be conveyed along the line by any means known in the art, such as by pinch rollers, vacuum drums, foraminous vacuum belts, and the like.

As used herein, the terms "absorbent garment" and "absorbent article" refer to devices that absorb and contain body fluids and other body exudates. More specifically, these terms refer to garments that are placed against or in proximity to the body of a wearer to absorb and contain the various exudates discharged from the body. A non-exhaustive list of examples of absorbent garments includes diapers, diaper covers, disposable diapers, training pants, feminine hygiene products and adult incontinence products. Such garments may be intended to be discarded or partially discarded after a single use ("disposable" garments). Such garments may comprise essentially a single inseparable structure ("unitary" garments), or they may comprise replaceable inserts or other interchangeable parts. The present invention may be used with all of the foregoing classes of absorbent garments, without limitation, whether disposable or otherwise.

An embodiment of the invention may be used in conjunction with a processing line that processes nonwoven materials and other materials into absorbent garments. The present invention may also be used with any other type of processing line, as will be evident to those skilled in the art. The invention will be understood to encompass, without limitation, all classes and types of processing lines for processing all types fabrics for all types of applications, including those described herein.

For clarity, features that appear in more than one Figure have the same reference number in each Figure.

The present invention deals particularly with the portion or portions of a processing line that cuts the web and removes the cutout material. FIG. 1 is a drawing of part of a processing line for processing a fabric web 102. The fabric web 102 may comprise one or more layers of fabric and other material. For example, the processing line of FIG. 1 may be part of an absorbent garment processing line. In such a case, the web 102 may comprise overlaid fabric webs, such as the overlaid topsheet, backsheet, elastic strands and absorbent core material of absorbent garments. In a preferred embodiment, the fabric web 102 is processed as a continuously moving web that travels in the machine direction; that is, the web 102 essentially does not stop moving during processing. The web 102 may also be processed, however, as an intermittently stopping web, in which case the web or a portion thereof may be stopped periodically to perform particular operations.

In one preferred embodiment shown in FIG. 1, the web 102 is cut at location A as it passes between a cutting die 104 and a cutting anvil 106. The cutting die 104 may comprise a rotating drum-like structure having one or more raised ridges 105. The raised ridges 105 have relatively sharp edges, and as the web passes between the ridges 105 and the surface of the cutting anvil 106, the web is severed by the sharp edges. The shape of the ridges 105 may be selected to cut any number of patterns on the surface of the web 102. In the embodiment illustrated in FIG. 1, the cutting die 104 is located above the cutting anvil 106, however it should be understood that these locations may be transposed.

In another embodiment (not shown), the web 102 may be cut by one or more hydraulic cutting jets. The jets may be pivotally mounted such that they may be swung in a predetermined pattern to cut cutouts 108 having a desired shape from the web 102.

As understood herein, the quality of the cut is a measure of how completely the cutting device severs the cutout material from the fabric web. A high quality cut (i.e., one leaving little or no material connecting the cutout 108 and the web 102) allows the cutout material to be removed with relative ease, and a low quality cut (i.e., one leaving a relatively greater amount of material connecting the cutout 108 and the web 102) makes it more difficult to remove the cutout material. In an embodiment using a rotating drum-type cutting die 104, the quality of the cut may be improved by providing sharper ridges 105. The quality of the cut may also be improved by positioning the cutting die 104 closer to the cutting anvil 106, thereby reducing the space between the ridges 105 and the cutting anvil 106, and subjecting the web to a greater amount of cutting pressure as it passes between the cutting die 104 and the cutting anvil 106. These methods of improving the cut quality have been found to be expensive and may lead to reduced cutting anvil 106 life.

Other cutting devices may also be used to cut the web 102, such as a lasers, high pressure water jets, fixed or moving knives, reciprocating cutting stamps, and the like. The present invention is not intended to be limited to any particular cutting device. The design and selection of cutting devices is known in the art, and a skilled artisan will be able to implement a cutting device with the present invention without undue experimentation.

Still referring to FIG. 1, after the fabric web is cut at location A, the web 102 and the cutout 108 continue along the processing line in the machine direction. At this point it may be desirable to remove the cutout 108 from the vicinity of the processing line to ensure that it does not become entangled in the line or the web or otherwise cause problems. The present invention uses a vacuum source (not shown) attached to a vacuum passage 112 to draw the cutouts 108 through a vacuum inlet plate 110, located at location B, and away from the web 102. The vacuum inlet plate 110 and other features of the preferred embodiments are described in more detail herein.

The vacuum passage 112 may comprise any type of duct or tunnel that is suitable for carrying a flow of air and cutouts 108. Typically, the vacuum passage may have a welded box-like construction, or a mechanically fastened sheet metal duct-type construction. The manufacture of such passages is known in the art.

The cutouts 108 may be cut from any part of the web 102. In the figures and the embodiments described herein, the cutout 108 is generally described and shown as being located in the middle of the web 102, but the cutouts may also be located toward one side of the web 102 or along the edge of the web 102. In addition, multiple cutouts may be located side-by-side on the web 102 or in a staggered or alternating pattern.

As the cutouts are removed at location B, the web 102 continues along the processing line. In the embodiment depicted in FIG. 1, the web 102 passes from the cutting station at location A to, for example, a vacuum drum 114 at location C. The vacuum drum 114 may be a rotating cylindrical drum having a number of holes on its surface through which a vacuum draws air radially towards the center of the vacuum drum 114. The vacuum drum 114 may be configured to hold the web against its surface and driven by a motor to assist with transporting the web 102 along the machine direction. Other devices may be employed at location C in addition to, or in place of, the vacuum drum 114, and the present invention is not intended to be limited to any particular device or devices that may be located after location B.

It has been found that improper cutout removal can be a substantial factor in reducing the overall efficiency of a processing line. Typically, if a cutout 108 is not properly removed, one or more products emerging from the line may be defective, and it may be necessary to stop the entire processing line. The line may have to be cleared or even repaired, and the fabric web 102, if damaged, may have to be replaced or indexed through the line to bypass the damaged portions. The cost of these problems to the manufacturer may increase as the speed of the web 102 increases. To combat this problem, traditional processing lines have employed high quality cutting devices to ensure that the cutouts are fully severed and easily removed by the vacuum removal system.

It has been discovered that by improving the performance of the vacuum removal system, rather than the cutting device, the overall incidence of improper cutout removal may be reduced. Surprisingly, by using the present invention, the quality of cut provided by the cutting devices may even be reduced while still obtaining improved cutout removal performance. In addition, because the quality of the cut is less critical, the cutting die 104 may be located farther from the cutting anvil 106, which may reduce the amount of pressure on the die 104 and cutting anvil 106 and may greatly increase the service life of the cutting die 106. The overall speed of the fabric web 102 may also be increased, leading to greater production efficiency.

It has been found that at least three general factors may be balanced to provide the benefits of the present invention. These general factors are: the vacuum inlet plate 110 shape; the vacuum inlet plate 110 position; and the vacuum level.

Vacuum Inlet Shape

The shape of the vacuum inlet 110 may be varied to provide improved cutout removal performance. The inlet plate 110 may be an integral part of the vacuum passage 112, or it may be a separate piece of material that is attached to the vacuum passage 112. A vacuum source is attached to the end of the vacuum passage 112 opposite the end to which the inlet plate 110 is attached. It may be desirable to fabricate the inlet plate 110 from one or more separate pieces of material, such as plate steel or aluminum, or plastic sheet, to allow more convenient machining of the inlet plate 110, and to facilitate experimentation with different inlet plate 110 geometries. In addition an inlet plate 110 made from a separate piece of material may be designed to allow convenient replacement and adjustments.

Figure 2A:
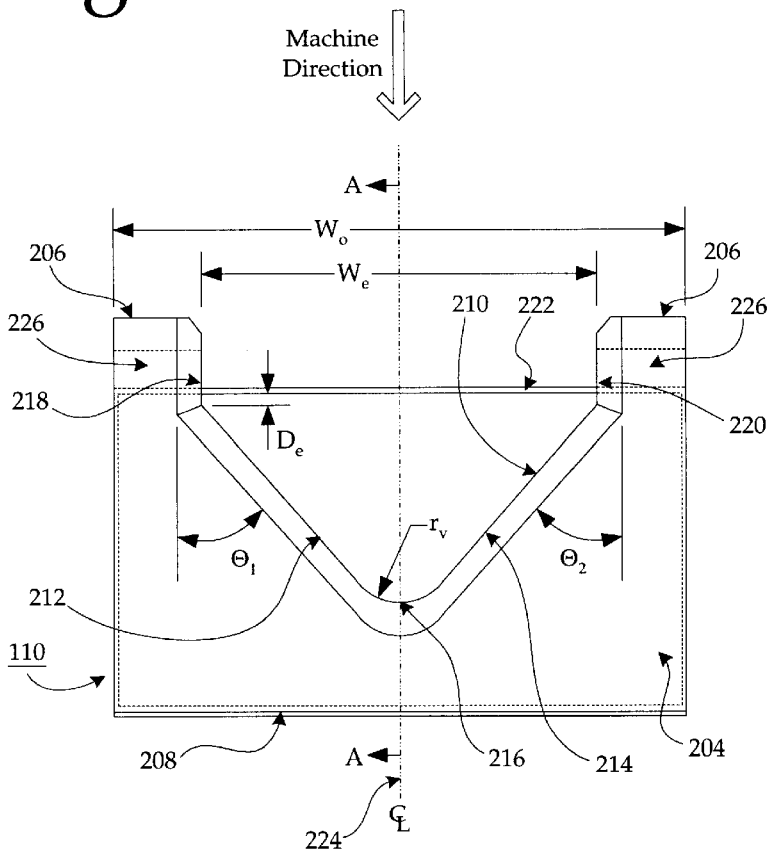
FIG. 2*a* is a plan view of a preferred embodiment of a vacuum inlet of the present invention, shown with a portion of the vacuum passage.
Figure 2B:
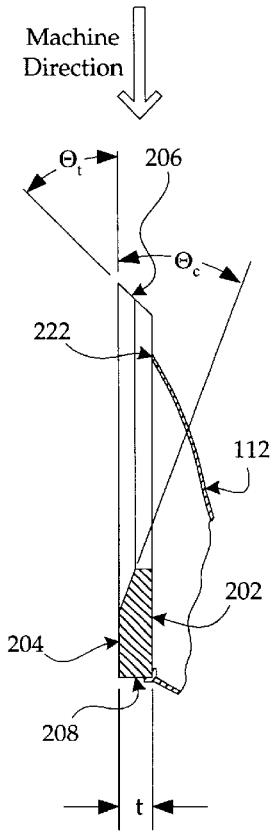
FIG. 2*b* is a side sectional view of the vacuum inlet of FIG. 2*a*, shown with a portion of the vacuum passage, as viewed from reference line AA.
Figure 2C:
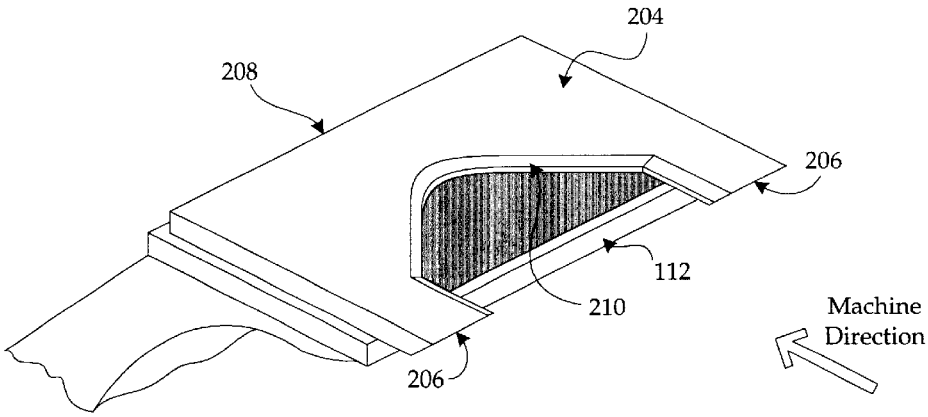
FIG. 2*c* is an isometric view of the vacuum inlet of FIG. 2*a*, shown with a portion of the vacuum passage.

Referring now to FIGS. 2*a*, 2*b*, and 2*c*, there is depicted top, side and isometric views, respectively, of a preferred embodiment of a vacuum inlet plate 110 of the present invention. FIG. 2*b* is partially cut away to show the structure of the embodiment as viewed from reference line AA. Also shown in FIGS. 2*a*, 2*b* and 2*c* is a portion of a vacuum passage 112. The inlet plate 110 in this embodiment generally has a flat, plate-like structure having an inner face 202 facing the vacuum passage 112, and an outer face 204 opposite the inner face 202 and proximal to the web 102. In other embodiments, the outer face 204 may be curved or have other shapes to provide additional benefits to the invention. The outer face 204 is preferably smooth enough so that the web 102 will not be damaged by rubbing against it. Typically, this level of smoothness may be obtained from a stock rolled plate or sheet metal surface. If the outer face 204 is not sufficiently smooth, it may be painted, polished, or otherwise treated to remove rough or sharp edges that may damage the web 102. Although the inlet plate 110 may operate properly with some degree of deflection or distortion, the inlet plate 110 preferably has a thickness t sufficient to resist substantial deformation by the vacuum or by contact with the web 102. In a preferred embodiment, the inlet plate 110 thickness t is at least about 0.317 centimeters (0.125 inches). In a more preferred embodiment the inlet plate 110 thickness t is about 0.635 centimeters (0.25 inches).

In one embodiment, the inlet plate 110 is made from a sheet of a plastic material. Plastics may provide certain benefits in this application. Plastics are typically smooth enough to prevent hooking or snagging on the web 102. Plastics are also inexpensive to form, and many different inlet plate shapes 110 may be experimented with without incurring excessive costs. In addition, a plastic inlet plate 110 may flex when the web 102 contacts it, providing some degree of shock absorption that may minimize damage to the web 102. In other embodiments, the inlet plate may be fabricated from metals like steel and aluminum, composite materials, such as fiber reinforced plastics, and so on. Although some materials may provide certain advantages in this application, any material may be successfully used for the inlet plate 110, provided it does not flex excessively or damage the web 102.

The vacuum inlet plate 110 has a leading edge 206 and a trailing edge 208. The leading edge 206 is the foremost edge (or edges) of the inlet plate 110, and the trailing edge 208 is opposite the leading edge 206. The leading edge 206 may be beveled with an undercut angle $\Theta_t$ (i.e., such that the outer face 204 is further forward than the inner face 202) to allow the outer face 204 to be located closer to the cutting anvil 106, or other cutting device, thereby reducing the likelihood that the web 102 will become trapped between the cutting device and the leading edge 206. In a typical embodiment, the leading edge undercut angle $\Theta_t$ is about 37.5 to about 52.5 degrees, more preferably about 42.5 to about 47.5 degrees, and most preferably about 45 degrees. The design of this angle may also vary with changes in the static offset h and the static angle of attack $\Theta_A$ (FIG. 5) of the inlet plate 110, as described in more detail herein. The leading edge may also be radiused to substantially conform to the radius of the cutting anvil 106. Those skilled in the art will be able to apply known geometric functions to obtain a desirable value for the undercut angle $\Theta_t$ without undue experimentation.

The vacuum inlet plate 110 has an inlet edge 210 that defines at least part of a passage through the inlet plate 110 and into the vacuum passage 112. The inlet edge 210 generally comprises a first angled edge portion 212 and a second angled edge portion 214 that approach one another at first and second angles $\Theta_1$ and $\Theta_2$, respectively, measured relative to the machine direction. The first and second angled edge portions 212, 214 preferably are substantially straight, but they may be slightly curved (i.e., having a radius of curvature greater than about 125% of the length of the angled edge portion). In one embodiment, the first and second angles $\Theta_1$, $\Theta_2$ are between about 20 degrees and about 80 degrees. In another embodiment, the first and second angles $\Theta_1$, $\Theta_2$ are between about 35 degrees and about 65 degrees. In a preferred embodiment, the first and second angles $\Theta_1$, $\iota_2$ are between about 50 degrees and about 55 degrees. In a most preferred embodiment, the first and second angles $\Theta 1$, $\Theta_2$ are about 52 degrees. In one embodiment, the first and second angles $\Theta_1$, $\Theta_2$ are substantially the same, such that the first and second angled edge portions 212, 214 are symmetrical, however the first and second angles $\Theta_1$, $\Theta_2$ may be substantially different. The selection of the proper values for the first and second angles $\Theta_1$, $\Theta_2$ is described in more detail below.

The first and second angled edge portions 212, 214 converge at a vertex portion 216, that may be a point or a radiused portion of the inlet edge 210. In one embodiment, the vertex radius $r_v$ is between about 0.635 centimeters and about 3.81 centimeters (0.25 to 1.5 inches). In a more preferred embodiment, the vertex radius $r_v$ is between about 1.27 centimeters and about 2.54 centimeters (0.50 to 1.0 inch). In a most preferred embodiment, the vertex radius $r_v$ is about 1.91 centimeters (0.75 inches). The inlet edge 210 is oriented such that the vertex portion 216 comprises the rearmost part of the inlet edge 210.

At their foremost ends (i.e., the ends opposite the vertex portion 216), the first and second angled edge portions 212, 214 are spaced apart by an entry width $W_e$. The entry width $W_e$ preferably is about the same size as the width of the cutout 108 to be removed, or slightly wider. Preferably the entry width $W_e$ is between about 90% and 120% of the width of the cutout 108. If the entry width $W_e$ is much narrower than the cutout 108, then the cutout 108 may be too large to easily pass through the inlet plate 110. If the entry width $W_e$ is much larger than the cutout 108, then the vacuum may be insufficient to draw the cutout 108 into the inlet plate 110, or the entire web 102 may be drawn into the inlet plate 110.

The inlet edge 210 may further comprise a first straight edge portion 218 extending in the machine direction from the end of the first angled edge portion 212 towards the leading edge 206, and a second straight edge portion 220 extending in the machine direction from the end of the second angled edge portion 214 towards the leading edge 206. In one embodiment of the invention, the straight edge portions 218, 220 terminate at the leading edge 206, as depicted in FIG. 1. In another embodiment of the invention, depicted in FIG. 3, the first and second straight edge portions 218, 220 may be connected by a front inlet edge 302 extending roughly perpendicular to the machine direction. In another embodiment, depicted in FIG. 4, the first and second straight edge portions 218, 220 may be omitted, and the first and second angled edge portions 212, 214 may terminate at the leading edge 206. The first and second angled edge portions 212, 214 may also be connected by a front inlet edge, without having intermediate first and second straight edge portions 218, 220.

Figure 3:
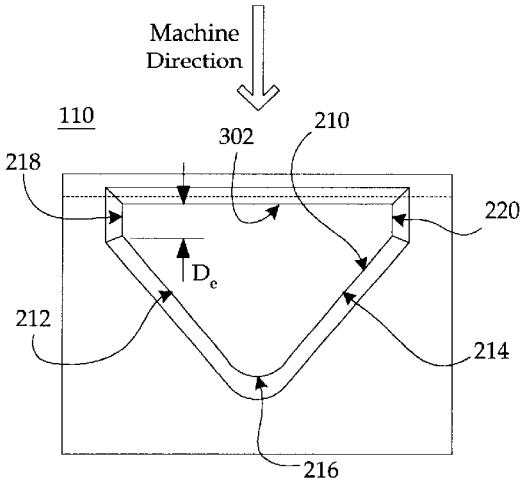
FIG. 3 is a plan view of another preferred embodiment of a vacuum inlet of the present invention.
Figure 4:
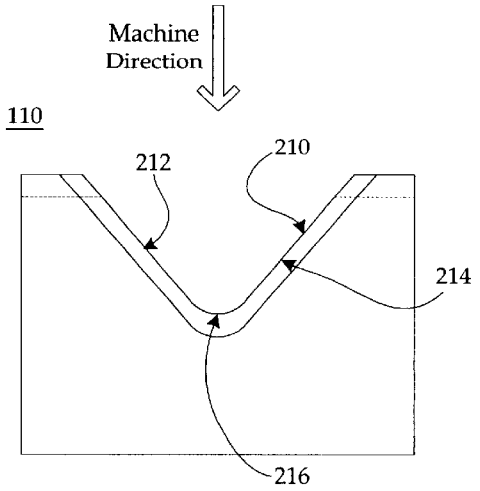
FIG. 4 is a plan view of yet another preferred embodiment of a vacuum inlet of the present invention.

The foremost periphery of the passage through the inlet plate 110 into the vacuum passage 112 may be defined by the vacuum passage leading edge 222, as in the embodiments of FIGS. 2 and 4, or by the front inlet edge 302, as depicted in FIG. 3. In the embodiment of FIG. 2, the vacuum passage leading edge 222 is located a distance $D_e$ from the transition between the first and second straight edge portions 218, 220 and the first and second angled edge portions 212, 214. Similarly, the front inlet edge 302 of the embodiment of FIG. 3 is located a distance $D_e$ from the corresponding structure of that embodiment. The distance $D_e$ is preferably less than about 3.810 centimeters (1.5 inches), and more preferably about 0.317 centimeters (0.125 inches).

All or part of the inlet edge 210 may be chamfered along the outer face 204 to allow the web 102 to pass easily across the inlet plate 110 and to reduce the likelihood that the web 102 will be caught on any sharp edges. In one embodiment, the chamfer angle $\Theta_c$ may be about 10 degrees to about 20 degrees relative to the outer face 204, and more preferably about 12.5 to about 17.5 degrees relative to the outer face 204, and most preferably about 15 degrees relative to the outer face 204. The chamfer may extend through the entire thickness t of the inlet plate 110, but preferably extends only about halfway therethrough to reduce the likelihood that the web 102 will be caught on a sharp edge that may be caused by cutting the chamfer through the entire thickness t. The inlet edge may also be rounded, instead of or in addition to being chamfered, to further reduce the likelihood of the web 102 being caught on a sharp edge.

The opening defined by the inlet edge 210 preferably is laterally centered on the longitudinal centerline 224 of the vacuum inlet plate 110, and also preferably has a symmetrical shape about the longitudinal centerline 224. The longitudinal centerline, in turn, preferably is located directly adjacent to the longitudinal centerline of the cutout 108. The outer face 204 of the vacuum inlet plate 110 extends laterally (i.e., perpendicular to the longitudinal centerline 224) away from the inlet edge 210 on either side to form a pair of landing zones 226. The landing zones 226 support the fabric web 102 as is passes across the outer face 204. The size of the landing zones may be increased by increasing the overall width $W_o$ of the vacuum inlet plate 110. Generally, it is preferred that the landing zones be large enough to fully support the portions of the fabric web 102 that are lateral to the cutout 108.

Figure 8:
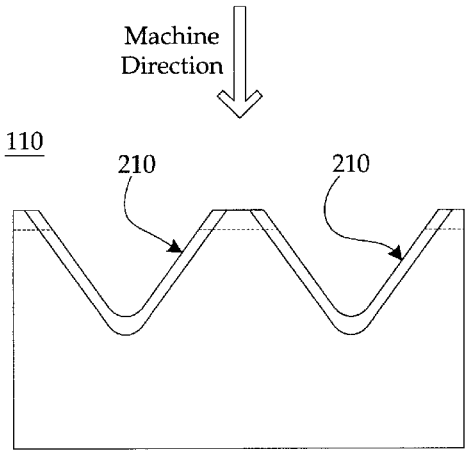
FIG. 8 is a plan view of another preferred embodiment of a vacuum inlet of the present invention.
Figure 9:
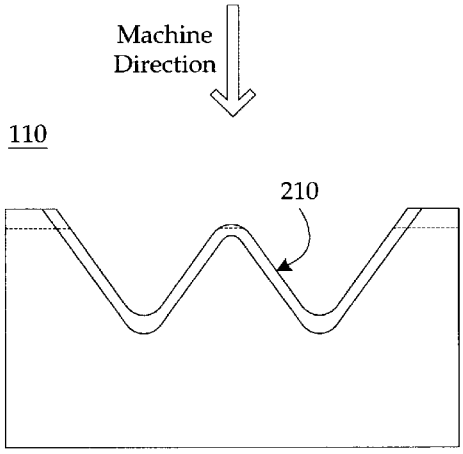
FIG. 9 is a plan view of yet another preferred embodiment of a vacuum inlet of the present invention.

The above embodiments describe and depict a vacuum inlet plate 110 that is generally designed for removing a series of single cutouts 108 (i.e., a single cutout 108 is severed from the web 102 with each pass of the cutting device). Embodiments of the present invention may also be used to remove multiple cutouts 108 at the same time or to remove cutouts 108 that are severed from different lateral portions of the web 102. As shown in FIG. 8, the vacuum inlet plate 110 may have a two or more inlet edges 210 defining separate openings to one or more vacuum passages 112, each of which is used to remove separate cutouts from the web. In another embodiment, depicted in FIG. 9, the vacuum inlet may have a single continuous inlet edge 210 that is shaped to remove several cutouts 108. Other variations will be apparent to those skilled in the art with reference to the teachings herein.

The various dimensions and shapes of the vacuum inlet plate 110 that have been described herein may be selected or modified according to the principles set forth in the Balancing the Variables section and the Example included below. These dimensions and shapes of the vacuum inlet plate 110 may also be modified as a function of the vacuum inlet position and the vacuum level, as described below. Other variations will be obvious to a skilled artisan in light of the teachings herein.

Vacuum Inlet Position

Figure 5:
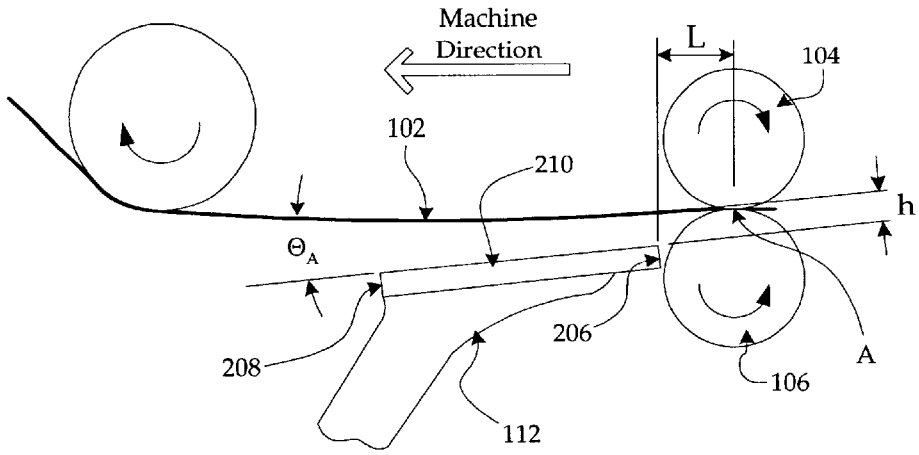
FIG. 5 is a side schematic view of a preferred embodiment of the present invention showing dimensional relationships.

Referring now to FIG. 3, the vacuum inlet plate 110 must be properly positioned to obtain the benefits of the present invention. During operation, the position of the fabric web 102 relative to the vacuum inlet plate 110 may fluctuate and be difficult to measure, and so the position of the inlet plate 110 may be most conveniently measured while the fabric web 102 is stopped and the vacuum source is removed, diverted, or turned off. These measurements are referred to herein as "static" measurements to indicate that they are taken while the processing line is at a standstill. Referring to FIG. 5, three major dimensions that may be considered are the static offset, h, the static angle of attack, $\Theta_A$, and the trailing distance, L (unlike the static offset h and the static angle of attack $\Theta_A$, the trailing distance typically does not vary significantly during operation).

The static offset h is the minimum distance between the inlet plate 110 and the web 102. It has been found that a static offset h of between about 0.635 cm and about 15.24 cm (0.25 to 6.00 inches) may be used with various types of web 102.

The static angle of attack $\Theta_A$ is a measurement of the difference in static offset between the leading edge 206 and the trailing edge 208. A positive angle indicates that the trailing edge 208 has a greater static offset than the leading edge 206 (i.e., the rear of the vacuum inlet plate 110 is tilted away from the web 102). It has been found that a static angle of attack $\Theta_A$ of between about 0 degrees and about 15 degrees may be used with various fabric webs 102.

The trailing distance L is the distance between the leading edge 208 of the inlet plate 110 and the cutting point (location A). Generally, it is desirable to minimize the value of the trailing distance L in order to remove the cutouts 108 as quickly as possible after they pass the cutting point. The value for the trailing distance may vary depending on the physical structure of the cutting device and the other dimensions and features of the inlet plate 110. For example, in the embodiment depicted in FIGS. 1 and 5, in which the cutting device is a rotating drum-type cutting die 104 having a counter-rotating drum-type cutting anvil 106, the trailing distance L may be dictated by the diameter of the cutting anvil 106 and the desired static offset h.

The position of the inlet plate 110 as described above may be varied between different applications in order to provide the greatest benefit for each application, and may vary as a function of the inlet shape as described above and the vacuum level as described below. General principles and guidelines for positioning the inlet plate 110 are provided below in conjunction with the Balancing the Variables section and the provided Example.

Vacuum Level

The amount of vacuum provided to the vacuum inlet plate 110 may be varied to provide more or less suction to remove the cutouts 108. The vacuum is provided to the inlet plate 110 by attaching the inlet plate 110 to one open end of a vacuum passage 112 and attaching a vacuum source to the other open end of the vacuum passage 112. Vacuum sources are known in the art, and a skilled artisan will be able to employ a vacuum source with the present invention without undue experimentation. For example, a conventional industrial air removal device, such as those that are present at many industrial facilities, may be used.

For purposes of this disclosure, the vacuum level is expressed as a positive number reflecting the magnitude of the difference in pressure between the vacuum and the ambient air; that is, greater vacuums are expressed as larger numbers, and a vacuum of zero would be equal to the ambient air pressure.

During operation of the present invention, the amount of vacuum at the inlet plate 110 varies as the web 102 moves towards and away from the outer face 204 of the vacuum inlet plate 110, causing momentary instances of increased vacuum. This aspect of the invention is described in more detail in conjunction with the Balancing the Variables section and the Example provided below. In order to set up the invention, the vacuum should be measured at a baseline level or in some other repeatable manner. One way to measure a baseline vacuum level is to measure the free vacuum at the inlet plate 110 when the inlet is unblocked (i.e., when the web 102 is removed or located far enough from the inlet plate 110 that it does not restrict airflow and increase the vacuum level).

The free vacuum level and the operating range of vacuum levels of the embodiments of the present invention may be similar to conventional levels of about 0.496 to 14.9 kPa (about 2 to 60 inches of water at 4 degrees Celsius), but may also increase during operation to exceed these levels. Preferably, the vacuum may increase during operation to as high a level as is necessary to remove the cutouts 108 without damaging the web 102. For example, in one embodiment, the free vacuum may be about 1.25 kPa, and the operating value of the vacuum may fluctuate between about 1.25 kPa and about 2.49 kPa, and may have peak values of between about 3.74 kPa and about 7.47 kPa, and possibly more. The invention is not intended to be restricted to any particular value or range of values for the vacuum.

Generally, the vacuum passage 112 should be substantially symmetrical to provide balanced airflow and vacuum to the vacuum inlet plate 110. In addition, the vacuum passage 112 should be approximately the same width as the cutout 108 to minimize internal turbulence within the passage 112, which may reduce the effectiveness of the invention. The vacuum passage 112 may also be ported with openings or openable orifices to allow bypass air to flow into the passage 112. The bypass air may be desirable, for example, to prevent excessive vacuum levels, and an openable orifice that opens when a pre-set vacuum level is reached (commonly known as a "pop-off" or bypass valve) may be employed.

The baseline amount of vacuum that should be applied to the inlet plate 110 to obtain the best results may vary depending on the properties of the web 102 and cutout 108 and the shape and position of the inlet 10, as described above. Typically, a higher vacuum level will provide improved cutout removal, but may also lead to an increased likelihood that the web 102 will be drawn into the vacuum inlet plate 110, torn, or otherwise subjected to potential damage. Guidance for selecting the proper level of vacuum is provided herein with reference to the below Balancing the Variables section and the Example.

Balancing the Variables

The many variables of the present invention should be balanced with each other to provide optimal cutout removal performance. The manner in which the many variables may be balanced to obtain optimal results may be guided by the following theories of operation, which reflect the current best understanding of the operation of the invention. The following theories of operation are included for illustrative use only, and it should be understood that the present invention is not intended to be restricted to these or any other theory of operation.

As currently understood, the present invention generally has two modes of operation, each corresponding to how completely or incompletely the cutout 108 has been severed from the web 102. When the web 102 passes over the inlet plate 110, the vacuum tends to draw the web 102 towards the inlet plate 110, and as the web 102 gets closer, the airflow into the vacuum passage 112 becomes restricted, and the vacuum level increases. If the cutout 108 has been relatively completely severed, such that the cutout 108 may be easily separated from the web 102, or can be removed with a relatively low amount of vacuum, then the present invention generally operates in a first mode. If the cutout 108 has been relatively incompletely severed, such that relatively more vacuum is required to pull the cutout 108 free from the web 102, then the invention generally operates in a second mode. It has not been found to be necessary to identify the exact circumstances that determine when the cutout 108 will be removed by the first mode or the second mode, and such a determination may be difficult to make. It is expected that this transition point will vary as the many variables are changed, and as the cutting device properties, such as its sharpness, change. In addition, the invention may operate in combined modes or other modes of operation.

Figure 6:
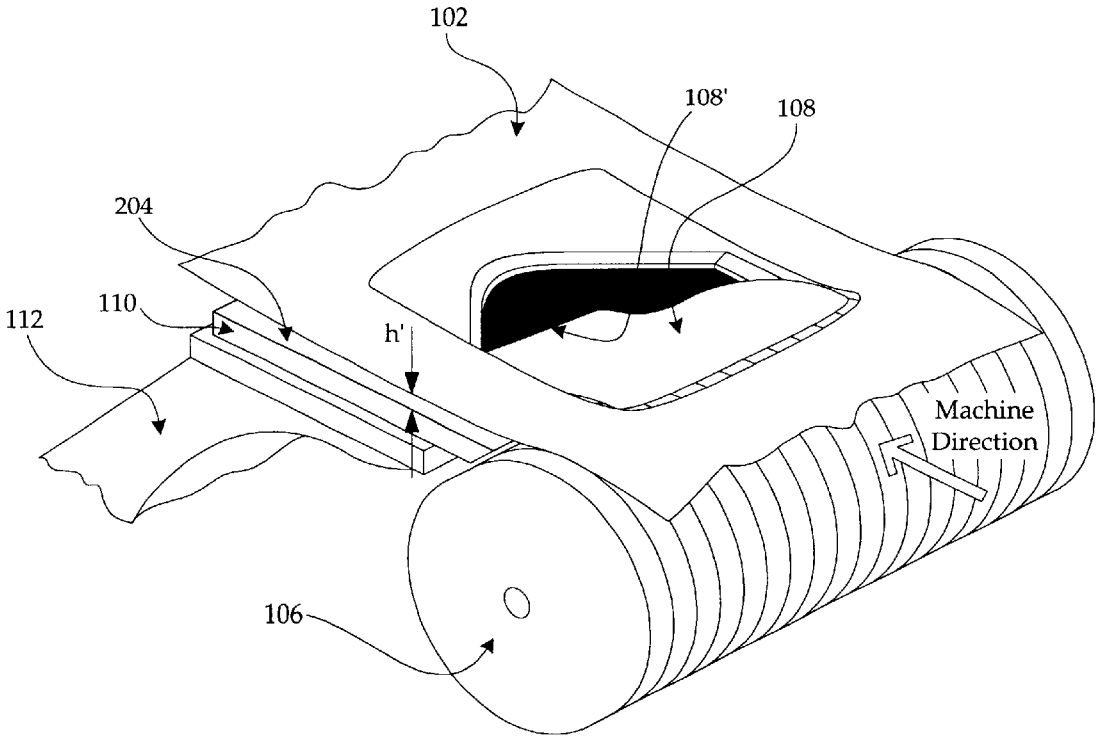
FIG. 6 is an isometric view of a preferred embodiment of the present invention in a first mode of operation, shown with the cutting die removed for clarity.

The first mode of operation is described with reference to FIG. 6. FIG. 6 depicts a portion of a fabric web 102 and a cutout 108 traveling in the machine direction over a cutting anvil 106 and a vacuum inlet plate 110 of the present invention. The cutting die 104, which might normally be directly above the cutting anvil 106, has been removed for clarity. In the first mode of operation, the cutout leading edge 108' is severed as it passes between the die 104 and cutting anvil 106, and is drawn through the inlet plate 110 and into the vacuum passage 112 immediately upon emerging from the cutting device. (As used herein, the "leading edge" 108' of the cutout 108 is the edge of the cutout 108 that passes over a given point on the processing line before the remaining edges of the cutout 108; that is, the downstream edge.) Once the cutout leading edge 108' passes into the vacuum passage 112, any uncut portions of the cutout 108 are severed as the vacuum pulls the cutout into the vacuum passage 112, generally through the widest portion of the opening. In order to maximize the ability of the cutout 108 to pass into the vacuum passage, the entry width $W_e$ should be approximately equal to the cutout width. The entry width $W_e$ may also be widened to account for lateral variations or play in the location of the web 102.

In the first mode of operation, the cutout does not substantially obstruct the opening through the vacuum inlet plate 110, and therefore the vacuum remains at a relatively low level. As the cutout 108 passes into the vacuum passage 112, air is free to pass through the cut out hole in the web 102, and so the vacuum does not tend to draw the web 102 very far towards the outer face 204. During this time, the web may be separated from the outer face 204 by a fluctuating dynamic offset h' that will typically be less than the static offset distance h. Once the cutout hole passes, however, the vacuum may draw the web 102 closer to or against the outer face 204, at which point the vacuum may increase. As the next cutout 108 begins to pass over and into the inlet plate 110 (assuming the cutout 108 is relatively well-severed and the invention is in the first mode of operation), the vacuum may drop and the web 102 may again rise up further from the outer face 204.

Figure 7:
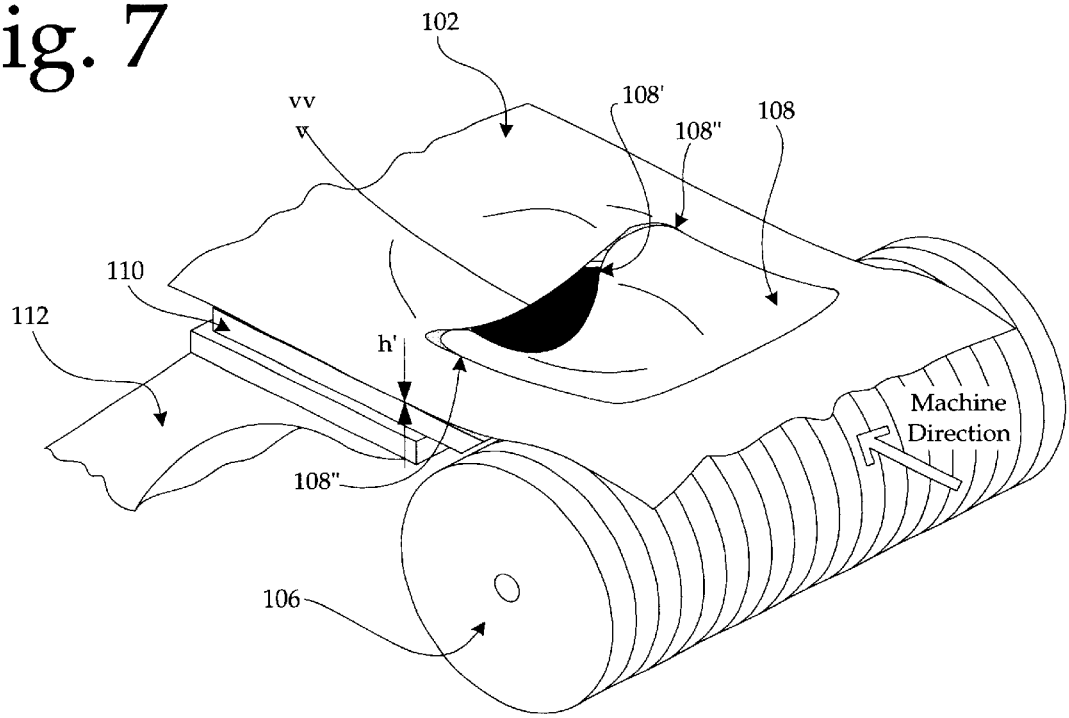
FIG. 7 is an isometric view of an embodiment of the present invention in a second mode of operation, shown with the cutting die removed for clarity.

In the second mode of operation, depicted in FIG. 7, the cutout does not immediately pass into the vacuum passage 112 as it emerges from the cutting device. As the web 102 passes over the inlet plate 110, the vacuum draws the web and the poorly severed cutout 108 near or against the outer face 204. As the web 102 and attached cutout 108 move closer to the outer face 204, the flow of air into the vacuum passage 112 becomes restricted, and the vacuum level increases. The increased vacuum pulls against the poorly severed cutout 108 with a greater force than it would if the cutout 108 had been more completely severed, thereby increasing the vacuum when the cutout 108 has not been completely severed. It thus may be seen that the operating vacuum has an inversely proportional relationship to the degree to which the cutout 108 has been severed—the more poorly the cutout 108 has been severed, the greater the applied vacuum.

The entry width $W_e$ (FIG. 2*a*) is approximately equal to the width of the cutout 108 (plus any additional width that may be desired to account for lateral play in the web's movement), so the increased vacuum force caused by the web 102 moving towards or against the outer face 204 on the web is localized in the region of the web 102 containing the unremoved cutout 108. At the forward portion of the inlet edge 210, where the passage through the inlet is widest, the increased vacuum pulls against the entire cutout leading edge 108', and the forces may be relatively evenly distributed over the unsevered strands or portions of the cutout 108 that connect it with the web 102. As the web 102 moves in the machine direction, the cutout front edge 108' moves towards the vertex portion 216 of the inlet edge 210, and the localized pressure becomes more focused towards the center of the cutout front edge 108' and consequently across fewer of the unsevered connections between the cutout 108 and the web 102, increasing the stress on each unsevered connection. It is postulated that as this occurs, a combination of forces caused by the vacuum pressure on the cutout 108 and momentum forces exerted on the cutout 108 by the inlet edge 210 as the web passes over the inlet plate 110 may work together to pull the cutout 108 free of the web 102. Once an opening between the web 102 and the cutout 108 is created, the combination of forces may become even more focused on the unsevered connections between the cutout 108 and the web 102, particularly on the local connections 108" that lie on either end of the opening. As these forces become more concentrated, the local connections 108" may be more easily severed by the vacuum and other forces (creating a "zipper" effect), and the cutout 108 may be quickly severed from the web 102 and drawn into the vacuum passage 112.

Ideally, the increased and localized pressure created by the unique shape of the invention is typically enough to initiate separation of the remaining unsevered portions of the cutout 108, but is not great enough to overcome the tension in the web 102 and pull the entire web 102 through the inlet plate 110. The lateral portions of the web 102 that are supported by the landing zones 226 may assist with preventing the web 102 from being pulled into the vacuum passage 112. For this reason, it may be desirable to make the overall width $W_o$ of the vacuum inlet plate 110 approximately equal to or slightly greater than the width of the web 102. The overall width $W_o$ may also be increased to account for play or other lateral movement in the web 102.

Additional or alternate theories may also explain how the present invention operates and obtains improved cutout removal performance, and the present invention is not intended to be limited to the above theories.

The features of the present invention may be tailored to accommodate fabric webs 102 having various physical properties. For example, one significant property of the web 102 that generally should be considered is the web's flexibility. More flexible webs, such as those that are wider, heavier, comprised of more flexible materials, under less tension and so on, may tend to be drawn towards the outer face 204 by the vacuum more easily than relatively rigid webs. The cutouts 102 of relatively flexible webs 102 may also be more susceptible to being separated by the "zipper" effect. Relatively flexible webs 102 may also be more susceptible to being drawn into the vacuum passage 112, which may cause damage to the web 102. Other differences between relatively rigid webs and relatively flexible webs may also exist. Many of the features of the invention may be modified to account for greater or lesser degrees of web flexibility, some of which are described as follows.

The static offset h of the web may be varied to accommodate webs 102 having different physical properties, such as stiffness. Stiffer webs 102 resist being drawn towards the outer face 204 by the vacuum and other forces (such as momentum and gravity) more than relatively flexible webs 102. Preferably, the vacuum can put enough force on the web 102 to draw the web 102 down into contact with the outer face 204 of the inlet plate 110, and so for a given baseline vacuum level, it has been found that the benefits of the present invention may be improved when the static offset h is reduced for relatively stiff webs 102 and increased for relatively flexible webs 102. Alternatively, the static offset h may be kept constant while the vacuum level is changed, or both the vacuum and the static offset h may be changed to obtain improved results.

In some cases the web 102 is more flexible in the center, and less flexible on either side. This may be particularly common when relatively wide webs 102 are processed. In such cases, it may be advantageous to design the static offset h to the requirements of the portion of the web having the cutout 108. For example if the cutout 108 is in the more flexible portion of the web, then the static offset h may be set relatively high. If, on the other hand, the cutout 108 is located along the side or edge of the web 102, where the web is relatively stiff, the static offset h may be set relatively low.

In some cases, the static offset for a relatively flexible web 102 may be decreased in order to prevent excessive movement of the web 102, which may cause inconsistent operation of the invention. As noted herein, the dynamic offset h' of the web 102 varies when the invention is in operation. When the static offset h is set at a relatively large value, the vacuum may draw a relatively flexible web 102 all the way down to the outer face 204 of the vacuum inlet plate 110. Upon release of the cutout 108, and the consequent reduction in vacuum, the flexible web 102 may tend to rebound away from the outer face 204 so far that the vacuum is unable to pull one or more subsequent cutouts 108 into the vacuum passage 112. In such cases, the rebound may be reduced or eliminated by reducing the static offset h.

The static angle of attack $\Theta_A$ may also be adjusted to accommodate different physical properties of the web. It has been found that the static angle of attack $\Theta_A$ may be relatively low or negative for relatively inflexible webs 102. In one embodiment, the inlet plate 110 has a static angle of attack $\Theta_A$ of zero degrees (i.e., the vacuum inlet plate 110 is parallel with the web 102). It may be desirable, to provide an increased positive static angle of attack $\Theta_a$ when a relatively flexible web 102 is being processed. The increased static angle of attack $\Theta_A$ may be desirable to prevent a flexible web 102 from colliding with the inlet edge, particularly in the vicinity of the vertex portion 216, thereby damaging the web 102. Some of the benefits of increasing or decreasing the static angle of attack $\Theta_A$ may also be realized by making the outer face 204 with a curved or arcuate shape.

The first and second angles $\Theta 1$, $\Theta_2$ may be adjusted to account for different web properties, including the web stiffness. It has been found that more flexible webs may benefit from greater values for the first and second angles $\Theta 1$, $\Theta_2$, and stiffer webs may benefit from smaller values for the first and second angles $\Theta_1$, $\Theta_2$.

Other features of the inlet edge 210 and the vacuum inlet plate 110 may also be modified to accommodate different properties of the web 102. For example, the thickness t of the vacuum inlet plate 110, the chamfer angle $\Theta_c$ and depth, the radius of the vertex $r_v$, and the smoothness of the vacuum inlet plate 110 surfaces and edges may be adjusted to increase or decrease the amount of mechanical force placed on the web 102, reduce the likelihood that the web will be damaged by the vacuum, and prevent cutting or tearing of the web 102. For example, a greater vertex radius $r_v$ may be desirable when a more flexible web 102 is being processed in order to reduce the amount of force placed on the web 102 in the event that it becomes wrapped around the inlet edge 210.

The amount of vacuum may also be varied to accommodate webs 102 having different properties and to provide optimal results from the present invention. The operating range of the vacuum level will typically depend on the shape and size of the passage through the vacuum inlet plate 110, and the extent to which the web 102 and cutouts 108 block this opening, thereby increasing the vacuum. In general, a greater vacuum will be required when the web is relatively stiff, when the static offset h is greater, when the cutout dimensions are greater, and when the web 102 has a greater resistance to severing. It may be desired for the vacuum to have enough force to pull part of the web 102 a small distance below the plane of the outer face 204 of the inlet plate 110 in order to improve the ability of the invention to remove cutouts 108. The vacuum level should not be so great, however, as to damage the web 102 by tearing the web 102 as the cutouts 108 are removed or by drawing the entire width of the web 102 through the inlet plate 110. The vacuum may be relatively easy to adjust and experiment with, and for this practical reason, the vacuum level may be selected after the vacuum inlet plate 110 has been designed and the static offset h has been established. Other changes in the setup and design of the invention may also make a greater or lesser vacuum level desirable, as will be apparent to those skilled in the art in light of the teachings herein.

The vacuum level and the static offset h may be adjusted together to obtain improved operation of the embodiments of the invention. In an exemplary case, when setting up the embodiment for operation with a new web 102, the static offset h may be initially established based on experience and technical judgment. The embodiment may then be accelerated to operating speed, and the vacuum level may be varied to achieve the desired cutout removal performance. As noted elsewhere, the cutout performance may be observed using stroboscopic analysis or high-speed photography. In addition, the web 102 may be inspected to determine whether the vacuum or contact with the vacuum inlet plate 110 are causing excessive damage to the web 102 or failing to remove the cutouts 108. If the embodiment can not achieve optimal cutout removal using the initial static offset h, then the static offset h may be adjusted and the vacuum level may again be adjusted while at operating speed to determine whether the embodiment is obtaining the desired cutout removal performance. For example, if the initial setup does not allow the web 102 to deflect enough to properly contact the vacuum inlet plate 110 without providing an excessive vacuum that damages or distorts the web 102, then the static offset height h may be decreased to allow cutout removal at a lower vacuum level.

In many cases, the fabric web 102 and cutouts 108 of the present invention may have substantially symmetrical properties across its width. In other cases, however, the density, strength, thickness, weight, stiffness, and other properties of the web 102 or cutouts 108 may be asymmetrically positioned across the width of the web 102 or cutouts 108. Typically, the present invention will be able to handle such asymmetrical webs 102 without modification, however, in some cases it may be desirable to modify the present invention to provide the greatest possible benefits. The following are some modifications that may be employed to account for asymmetrical web 102 and cutout 108 properties.

The vacuum inlet plate 110 may be tilted along its lateral axis so that one side of the inlet is closer to the web 102 than the other side. For example, in an embodiment in which the web 102 is substantially stiffer along one side than the other, the side of the inlet plate 110 corresponding to the stiffer side of the web 102 may be tiled towards the web 102, thereby reducing the effective value of the static offset h of that side and obtaining the corresponding benefits.

The first and second side edge angles $\Theta_1$, $\Theta_2$ may be made with different values to accommodate different properties in the web 102. For example, the first or second side edge angles $\Theta_1$, $\Theta_2$ may be greater to provide greater separating force to a more flexible portion of the web 102, or to accommodate offset cutouts 108 or cutouts 108 having asymmetrical shapes.

The vacuum passage 112 may be shaped to provide a greater or lesser vacuum to either side of the web 102. In addition, the vacuum passage 112 may be ported on one side to allow bypass air to flow into the passage 112, thereby reducing the vacuum on that side. Such a vacuum differential may be desirable to provide greater separating force to portions of the cutout 108 that are more likely to be less completely severed. For example, one side of the web 102 may comprise greater or fewer layers of material, possibly causing an imbalance in the degree to which the sides of the cutout 108 are severed by the cutting device. As another example, one side of the web 102 may comprise material having a greater resistance to cutting, such as an elastic film that may tend to deform elastically under the force provided by the cutting device, and a greater amount of vacuum may be desired on that side.

Other modifications to account for an asymmetrical web 102 will be apparent to those skilled in the art in light of the teachings provided herein.

Other properties, in addition to or in lieu of the web's flexibility and other properties described herein, may drive the design of the present invention. For example, another property that may be considered when implementing the present invention is the relative strength of the web 102. Webs 102 comprising stronger fibers or film materials may require greater vacuum, different inlet plate 110 shapes, and so on. A skilled artisan, using the guidelines provided herein, will be able to recognize additional factors that drive the proper implementation of the present invention, and will be able to practice the present invention without undue experimentation.

As noted, the many variables of the present invention must be balanced for each given application. Establishing these variables may be facilitated through the use of high-speed cameras, which may be used to see how the web 102 is behaving as it passes across the inlet plate 110. In addition, strobe lights may be timed to illuminate the web 102 at a frequency approximately equal to the frequency at which the cutouts 108 pass across the inlet plate 110. Other methods for establishing the variables of the present invention may also be used.

EXAMPLE

It has been found that an exemplary embodiment of the present invention having the following properties for the web 102, vacuum inlet plate 110 shape, vacuum inlet plate 110 position, and vacuum level has provided improved cutout removal, increased processing line speed, and increased cutting die 104 longevity.

The fabric web 102 of the exemplary embodiment is a laminated web that is part of an absorbent garment processing line that produces children's training pants. The outermost layers of the exemplary web 102 comprise a nonwoven topsheet layer on one side, and a nonwoven backsheet layer on the opposite side. Located between the outermost layers of the web 102 are elastic strands and an absorbent structure of super absorbent polymer, fiberized pulp and tissue contained between a moisture barrier layer of polyethylene film and a nonwoven fluid intake layer. The various layers of the web 102 are held together by adhesives. The absorbent structure may be placed continuously along the web 102, or alternatively, a supply of absorbent structures may be placed intermittently along the web 102 at predetermined locations. The cutouts 108 generally comprise portions of the backsheet, but may also comprise portions of the topsheet, absorbent structure, or other parts of the web 102.

The exemplary web 102 has a width of between about 49.0 to about 55.5 centimeters (19.29 to 21.85 inches), and is preferably about 54.0 centimeters wide (21.26 inches). The exemplary web travels at a rate of between about 50 meters per minute (164 ft/min) and about 500 meters per minute (1,640 ft/min). The web 102 is cut by a rotating drum-type cutting die 104 to form cutouts 108. Each cutout 108 has a width of about 25.4 centimeters (10 inches), and a surface area of between about 100 square centimeters (15.5 square inches) and about 1000 square centimeters (155 square inches).

The vacuum inlet plate 110 of the exemplary embodiment, depicted in FIG. 2, is made from a 0.635 centimeters (0.25 inch) thick steel plate having an overall width $W_o$. of about 33.0 centimeters (13 inches). The entry width $W_e$ is about 25.4 centimeters (10 inches).

The inlet edge 210 of the exemplary embodiment, which is depicted in FIG. 2, comprises first and second angled edge portions 212, 214, that diverge from the machine direction by substantially equal first and second angles $\Theta_1$, $\Theta_2$ of about 50 degrees to about 55 degrees, and preferably about 52 degrees. The first and second angled edge portions 212, 214 converge at a vertex portion 216 having a radius of about 1.91 centimeters (0.75 inches). The inlet edge 210 further comprises first and second straight edge portions 218, 220, each extending forward from ends of the respective angled edge portions 212, 214 by a distance of about 3.18 centimeters (1.25 inches), and terminating at the leading edge 206 of the inlet plate 110. The vacuum passage leading edge 222 is flush with the inner face 202 and extends generally perpendicular to the machine direction between the first and second straight edge portions 218, 220, and intersects the inlet edge 210 at a distance $D_e$ of less than about 0.635 centimeters (0.25 inches) forward of the transition between each angled edge portion 212, 214 and its respective straight edge portion 218, 220.

The outer face 204 of the vacuum inlet plate 110 is chamfered at an angle $\Theta_c$ of about 15 degrees relative to the outer face 204 along the first and second angled edge portions 212, 214 of the inlet edge 210 of the exemplary embodiment. The chamfer extends approximately 0.317 cm (0.125 inches) through the thickness t of the inlet plate 110.

The leading edge 206 of the exemplary embodiment is beveled at an undercut angle $\Theta_t$ of about 45 degrees.

The vacuum inlet of the exemplary embodiment has a static offset h of about 4.00 centimeters to about 5.00 centimeters (1.58 to 1.97 inches). The trailing distance L is about 10 centimeters, and the static angle of attack $\Theta_A$ is about zero degrees.

The exemplary embodiment uses a baseline vacuum level of about 1.62 kPa. The vacuum level of this embodiment fluctuates between about 1.25 kPa and about 2.49 kPa, and may have peak values around 4.98 kPa.

The above-described exemplary embodiment has been used in conjunction with a conventional cutting die 104 to provide several surprising and unexpected improvements in the processing line. First, a significant reduction in the frequency and amount of improper cutout removal has been attained without an increase in damage to the web 102. Second, because the vacuum inlet plate 110 is able to remove relatively poorly severed cutouts 108 without damaging the web 102, the die cutter of the exemplary embodiment has been operated with reduced edge sharpness and at a reduced cutting pressure (i.e., the cutting die 104 is located relatively far from the cutting anvil 106 when compared with conventional cutting dies), thereby extending the normal die cutter life of about 2–5 million cycles to more than 80 million cycles. Third, it has been found that the speed of the web 102 may also be increased when using the present invention. These and other improvements have increased the production line productivity, and reduced manufacturing costs. Other benefits may also be realized using the above exemplary embodiment and other embodiments of the present invention.

Other embodiments, uses, and advantages of the invention will be apparent to those skilled in the art from consideration of the specification and practice of the invention disclosed herein. The specification should be considered exemplary only, and the scope of the invention is accordingly intended to be limited only by the following claims.

I claim:

1. An apparatus for removing cutout material that is at least partially severed from a web moving in a machine direction, the apparatus comprising:

a vacuum passage for drawing a vacuum;

a vacuum inlet plate connected to the vacuum passage, the vacuum inlet plate comprising an inlet edge defining at least part of an opening into the vacuum passage; and wherein the inlet edge comprises first and second angled edge portions converging at first and second angles relative to the machine direction, respectively, to meet at a vertex portion, the vertex portion comprising the rearmost portion of the inlet edge relative to the machine direction.

2. The apparatus of claim 1, wherein the intended cutout material has a surface area of between about 100 square centimeters and about 1000 square centimeters.

3. The apparatus of claim 1, wherein the web comprises a fabric web of nonwoven material.

4. The apparatus of claim 1, wherein the web moves in the machine direction at a velocity of between about 50 meters per minute and about 500 meters per minute.

5. The apparatus of claim 1, wherein the vacuum is between about 0.496 to about 3.74 kPa with intermittent vacuum levels between about 3.74 to about 7.47 kPa.

6. The apparatus of claim 1, wherein the vacuum increases in inverse proportion with the degree to which the cutout material has been severed from the web.

7. The apparatus of claim 1, wherein the vacuum inlet plate is substantially flat.

8. The apparatus of claim 1, wherein the vacuum inlet plate is separated from the web by a static offset distance, as measured when the web is stationary and the vacuum is zero.

9. The apparatus of claim 8, wherein the static offset distance is less when the web has a relatively high resistance to deflection and greater when the web has a relatively low resistance to deflection.

10. The apparatus of claim 8, wherein the static offset distance is between about 0.635 centimeters and about 15.24 centimeters.

11. The apparatus of claim 8, wherein the static offset distance is about 4.00 centimeters.

12. The apparatus of claim 1, wherein the vacuum inlet plate is tilted along the machine direction to be oriented relative to the fabric web at a static angle of attack, as measured when the fabric web is stationary and the vacuum source is zero, wherein a positive measurement of the static angle of attack indicates that the vacuum inlet plate diverges from the web along the machine direction and a negative measurement indicates that the vacuum inlet plate converges with the web along the machine direction.

13. The apparatus of claim 12, wherein the static angle of attack is less when the web has a relatively high resistance to deflection and greater when the web has a relatively low resistance to deflection.

14. The apparatus of claim 12, wherein the static angle of attack is between about negative 5 degrees and about 15 degrees.

15. The apparatus of claim 12, wherein the static angle of attack is about zero degrees.

16. The apparatus of claim 1, wherein the widest portion of the opening into the vacuum passage is between about 90% to about 120% of the width of the cutout material.

17. The apparatus of claim 1, wherein the widest portion of the opening into the vacuum passage is between about 100% to about 110% of the width of the cutout material.

18. The apparatus of claim 1, wherein the widest portion of the opening into the vacuum passage is between about 21.6 centimeters and about 29.2 centimeters.

19. The apparatus of claim 1, wherein the widest portion of the opening into the vacuum passage is about 25.4 centimeters.

20. The apparatus of claim 1, wherein the vacuum inlet plate further comprises an inner face facing the vacuum passage and an outer face opposite the inner face, the outer face being chamfered along at least part of the inlet edge.

21. The apparatus of claim 1, wherein the first and second angles are approximately equal in magnitude to one another.

22. The apparatus of claim 1, wherein the first and second angles are between about 20 degrees and about 80 degrees.

23. The apparatus of claim 1, wherein the first and second angles are between about 35 degrees and about 65 degrees.

24. The apparatus of claim 1, wherein the first and second angles are between about 50 degrees and about 55 degrees.

25. The apparatus of claim 1, wherein the first and second angles are about 52 degrees.

26. The apparatus of claim 1, wherein the first and second angles are selected to be relatively great when the web has a high resistance to deflection and selected to be relatively less when the web has a low resistance to deflection.

27. The apparatus of claim 1, wherein the vertex portion has a radius of between about 0.635 centimeters and about 3.81 centimeters.

28. The apparatus of claim 1, wherein the vertex portion has a radius of between about 1.27 centimeters and about 2.54 centimeters.

29. The apparatus of claim 1, wherein the vertex portion has a radius of about 1.91 centimeters.

30. The apparatus of claim 1, wherein the inlet edge further comprises first and second straight edge portions extending forward and substantially parallel with the machine direction from respective ends of the first and second angled edge portions opposite the vertex portion.

31. An apparatus for removing cutout material that is at least partially severed from a fabric web moving in a machine direction, the apparatus comprising:

a vacuum passage for conveying a vacuum;

an inlet, connected to the vacuum passage, having an inner face facing the vacuum passage, an outer face opposite the inner face, a trailing edge located in a furthest position relative to the machine direction, and a leading edge opposite the trailing edge;

the inlet having an inlet edge defining an opening that allows the passage of the cutout material into the vacuum passage;

the inlet edge comprising a first angled edge portion and a second angled edge portion, the first angled edge portion oriented at a first angle relative to the machine direction, and the second angled edge portion oriented at a second angle relative to the machine direction;

the first angled edge portion and the second angled edge portion converging at a vertex portion;

the inlet edge being oriented such that the vertex portion is at the rearmost point of the inlet edge along the machine direction.

* * * * *